United States Patent [19]

Genovese, Jr.

[11] Patent Number: 5,025,524

[45] Date of Patent: Jun. 25, 1991

[54] DISPOSABLE TOILET SEAT WIPE APPARATUS WITH SEPARATION ACTUATION

[76] Inventor: Philip A. Genovese, Jr., 550 Ocean Ave., Apt. 11H, Monmouth Beach, N.J. 07750

[21] Appl. No.: 519,725

[22] Filed: May 7, 1990

[51] Int. Cl.[5] ..... A47L 13/17; B65D 83/00

[52] U.S. Cl. ..... 15/104.94; 4/233; 15/209 R; 15/210 R; 15/212; 118/264; 206/205; 206/361; 206/804; 206/823; 401/130; 401/262

[58] Field of Search ..... 15/104.93, 104.94, 209 R, 15/209 D, 210 R, 244 R, 244 B, 244 C, 244.1, 244.4, 212, 214; 206/15.2, 38, 205, 233, 361, 581, 804, 812, 823; 221/22, 23, 36, 312 C; 401/132–135, 196, 122, 130, 150, 202, 261, 262, 266, 292; 4/233; 118/264–266

[56] References Cited

U.S. PATENT DOCUMENTS

| | | | |
|---|---|---|---|
| 3,000,035 | 9/1961 | Harris et al. | 401/122 |
| 3,214,782 | 11/1965 | Masters et al. | 401/122 |
| 3,240,326 | 3/1966 | Miller | 4/233 X |
| 3,692,417 | 9/1972 | Aston | 401/122 |
| 4,575,891 | 3/1986 | Valente | 15/104.93 |
| 4,601,081 | 7/1986 | Sutton et al. | 15/210 R |
| 4,873,728 | 10/1989 | Bono | 4/233 |
| 4,881,278 | 11/1989 | Farah | 206/361 X |

FOREIGN PATENT DOCUMENTS

| | | | |
|---|---|---|---|
| 2422564 | 12/1979 | France | 401/202 |

*Primary Examiner*—Philip R. Coe
*Assistant Examiner*—C. Cooley
*Attorney, Agent, or Firm*—Charles I. Brodsky

[57] ABSTRACT

The disposable toilet seat wipe apparatus of this invention includes a pre-moistened, cleansing pad within a carrying container having a pair of component sections separable one from another, and by a pull-apart action, for example. The cleansing pad is initially stored in one of the two sections, and is coupled with a rod extending from within the other section. As the two sections are separated, an inner lip of the first section contacts with the pad to "blossom" it outwardly, as the sections continue to part. The pre-moistened cleansing pad so deployed can then be used in wiping the seat.

7 Claims, 1 Drawing Sheet

DISPOSABLE TOILET SEAT WIPE APPARATUS WITH SEPARATION ACTUATION

FIELD OF THE INVENTION

The present invention relates to disinfecting cleaning aids, in general, and to disposable apparatus for permitting an individual to disinfect a toilet seat before use, in particular.

BACKGROUND OF THE INVENTION

As is well known and understood, individuals who have the need to use a public restroom are not very desirous of using the toilet seat generally provided. In some areas of the country and of the world, apparatus may be available to provide toilet seat shaped tissue paper covers to be placed over the seat prior to use. Although helpful, those covers are of a basic configuration, and do not always cover the seat area in question, and are not always available because of the cost involved in installation and in maintenance.

As is also well known and appreciated, the process of addressing this problem then typically entails the simple process of tearing various lengths of toilet paper from off the roll in an attempt to correspond to the configuration of the seat. While satisfactory in concept, the carrying out of such plan often suffers, as the laid-out strips of paper do not readily remain in place, but shift in position, both prior to and during use. Of perhaps greater importance, however, is that not all the public restroom facilities offer toilet paper (in rolls), but provide folded, inter-leaved sheets, to then be positioned one adjacent the other on the toilet seat in going around the toilet seat shape. Besides being cumbersome to follow—and difficult to retain the individual sheet sections in position—, this procedure is both time consuming to carry out, and awkward in realization.

As an alternative to the use of such protective devices, others have come forward to suggest that disinfecting cleansing pads be employed, instead. These pads, the arguments go, can be pre-moistened with a germicidal, or other, cleansing agent, can be small enough to be easily carried about, and can be made readily available to wipe the surface of the toilet seat prior to its use. Suggestions abound as to the specific formulation of the antiseptic solution, with or without scenting, with various drying rates, with a variety of shelf lives prior to use, and with various degrees of constructions so as to be decomposable in water, so as to be flushed away with the toilet wastes. Prior art descriptions, for example, suggest that pads be made of synthetic fibers are preferable to using natural fibers; others suggest formulations of resins to provide wet strength along with "flushability"; some prior art pronouncement point out the advisability of incorporating alcoholic solutions, mercury zinc cyanide solutions, with, or without, quick-drying characteristics.

However, and as will be seen, except for perhaps cost, there does not appear to be a great deal of difference between individual ones of these suggested alternatives, as would induce an individual to purchase one as compared to the other. And, as will also be seen, one of the major disadvantages in all of these suggested alternatives is that the individual must, of necessity, place his, or her, hand close to the unsanitized toilet seat in utilizing the cleansing pad being offered. Typical of such type of device is the one shown in U.S. Pat. No. 4,575,891, where a 2"×2" pad is described, to have a raisable thumb tab to be grasped in use—as there shown, the tab is of the order of perhaps ½"; and, as will be seen, even the dimensions afforded may not be enough to disinfect the toilet seat in a single pass, but repeated back-and-forth actions would be generally required to sanitize the entire seat surface which may be contacted during use.

SUMMARY OF THE INVENTION

As will become clear hereinafter, the disposable toilet seat wipe apparatus of this invention includes a pre-moistened, cleansing pad within a carrying container having a pair of compartment sections separable one from another, and by a pull-apart, or screw-apart action, for example. The cleansing pad employed will be seen to be initially stored in one of the two sections, and is coupled to a rod extending from the other section. As the two sections are to be separated, an inner lip provided on the first section contacts the pad to "blossom" it outwardly as the sections continue to part. The pre-moistened cleansing pad so deployed can then be used in wiping the seat.

As will be understood, the cleansing pad can be fabricated of any particular material, either of synthetic or natural fiber, and can be moistened with any cleansing, sanitizing, or germicidal solution. As will also be understood, the first section of the carrying container is then discarded, and the second section —with the rod, and the "blossomed-out" pad secured—then serves as the handle for cleaning the toilet seat, with the dimensions selected for the cleansing pa and for the length of the rod and second section being such that the toilet seat can be cleansed in a swathe of approximately 3½ inches, and from a displaced height of approximately that same amount. As will also be apparent, the dimensions selected for the carrying container will be such as to allow the apparatus to be easily carried about, and to be dispensable from a vending machine located adjacent to the public restroom.

BRIEF DESCRIPTION OF THE DRAWING

These and other features of the present invention will be more clearly understood from a consideration of the following description, taken in connection with the accompanying drawing, in which.

DETAILED DESCRIPTION OF THE DRAWING

Figure 1:
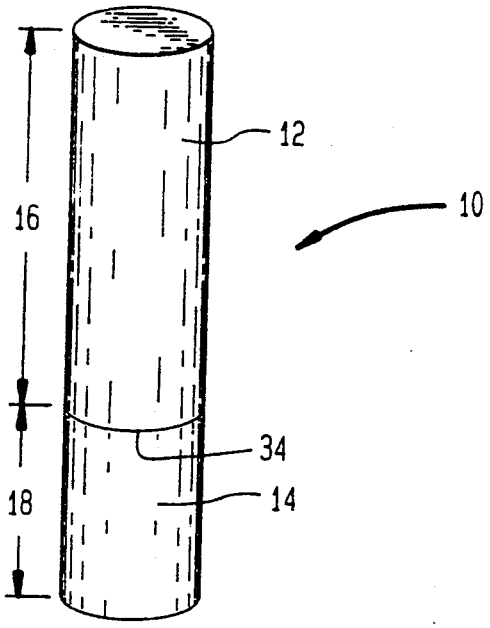
FIG. 1 shows the disposable toilet seat wipe apparatus of the invention, as it would appear prior to use.
Figure 2:
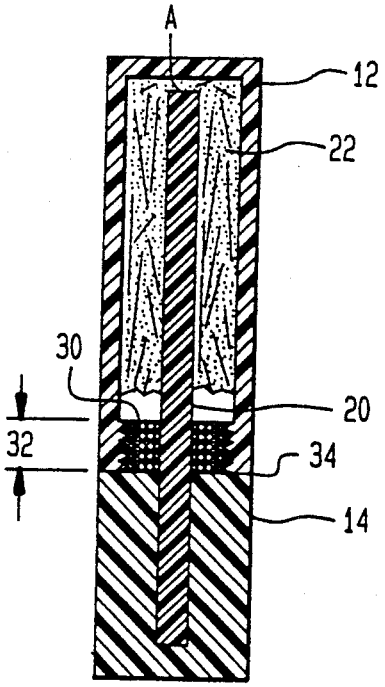
FIG. 2 is a sectional view of the apparatus helpful in an understanding of a preferred embodiment.

Referring to FIGS. 1-3, the disposable toilet seat wipe apparatus of the invention is incorporated within a container 10 having upper and lower component sections 12, 14 with the section 12 being preferably twice the length of the section 14–dimension 16 as compared to dimension 18. Such sections 12 and 14 are adapted to be separable, either by pull-apart, or screw-apart operation.

The sectional view of FIG. 2 shows the section 14 as having secured to its lower end a rod 20 about which is folded and compressed a cleansing pad 22 coupled to the rod 20 at its upper end A, along a central portion 25 of the pad 22. In accordance with a preferred embodiment of the invention, the pad 22 may be selected of a rectangular configuration, approximately $1\frac{3}{4} \times 3\frac{1}{2}$ inches, or may be of a circular configuration, $3\frac{1}{2}$ inches in diameter. As previously mentioned, any desired material can be employed for the pad 22, and it can be impregnated with any of a germicidal, sanitizing, or disinfecting solution, as desired, preferably of a long-lasting shelf life, yet quick drying after application. And, as will also be seen, the top section 12 of the container 10 has an internal, inner lip 30, extending inwardly of the section 12 a distance 32 from its lower-most end 34.

Figure 3A:
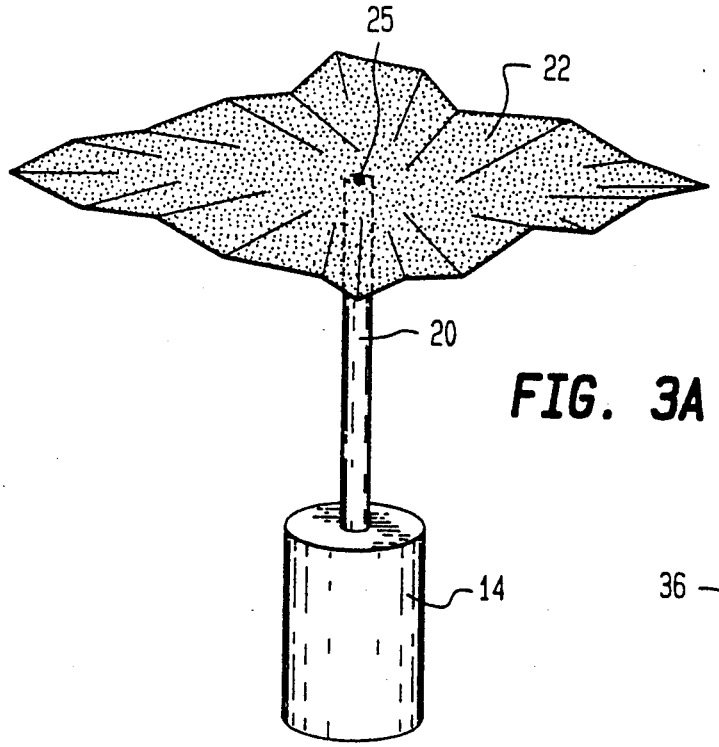
FIGS. 3A and 3B illustrate the component parts of the apparatus once it is ready for use in cleansing the toilet seat area.
Figure 3B:
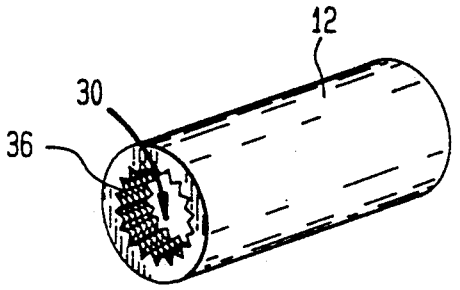

More particularly shown in the break-away view of FIG. 3B, such inner lip 30 is provided with tooth, or other rib-extensions to grasp onto the folded pad 22 as the section 12 is being moved upwardly, as shown in the drawing. With the section 12 continuing to be moved upwardly, the tooth projections 36 continue to draw the pad 22 outwardly from its compressed position, to essentially fold the pad 22 upwardly over itself, which can then be shaken out once the cap section 12 is removed. Once shaken out, the folded over pad 22 will present the "flower" shape of FIG. 3A, in full "bloom" position, and ready for use. In a preferred construction of the invention, the two sections 12, 14 are selected of approximately 2" and 1" lengths accordingly, with the diameter of the handle 10 being selected of the order of $\frac{3}{4}$". The rod 20, in such construction, may be of the order of $\frac{1}{4}$" wide, with an overall length of 2" extending from the bottom of the section 14. In use, the section 14 of FIG. 3A is merely grasped by the user as a handle, inverted downwardly, and the deployed pad 22 then used as the swab in cleaning the toilet seat.

While there have been described what are considered to be preferred embodiments of the present invention, it will be readily appreciated by those skilled in the art that modifications can be made without departing from the scope of the teachings herein, of using the separation of one section to deploy the cleansing pad in a "blossom" to serve as the toilet seat wipe. Thus, a cylindrical configuration for the container is not a necessity, the overall lengths and dimensions set forth serve only as illustrative examples, and any types of materials can be employed in the manufacture, as long as the separation of one from another—be it by pull-apart, by screw-apart, or other action —yields the resultant "flowering" in establishing the pad configuration for wiping use. As will also be appreciated, the container 10 and its included components may be packaged for storage and use in any suitable wrapper or envelope for sealing against moisture or air, as might be available. As will additionally be appreciated, added rigidity may be afforded to the pad of the construction, where desired, through any appropriate backing, or stiffening member, flexible or otherwise, while still retaining the ability to "blossom" out during the wipe operation. For at least such reasons, therefore, resort should be had to the claims appended hereto for a true understanding of the scope of the invention.

I claim:

1. A disposable toilet seat wipe, comprising:

a normally closed container having first and second separable sections;

a handle secured to one end of said first section and of a length to extend into said second section;

a cleaning pad, pre-moistened with any of a germicidal, sanitizing, disinfecting or similar like solution folded around said handle where said handle extends into said second section, and said cleaning pad, when opened, having a centralized section to which a tip of said extending handle is secured;

and with said second section having an inner lip configured to grasp onto said folded cleaning pad as said firs and second sections are begun to be separated;

with said lip configuration grasping said cleaning pad to continue to pull said pad from its folded position as said first and second sections continue to be separated; and with said lip configuration pulling said pad to an unfolded position about said handle when said first and second separable sections are fully separated.

2. The disposable toilet seat wipe of claim 1 wherein said inner lip of said second section incorporates a plurality of inwardly facing tooth projections.

3. The disposable toilet seat wipe of claim 2 wherein said first section is of a length approximately one-half the length of said second section.

4. The disposable toilet seat wipe of claim 1 wherein said cleaning pad, when opened, is of circular configuration, approximately $3\frac{1}{2}$ inches in diameter.

5. The disposable toilet seat wipe of claim 1 wherein said container has a length when closed of approximately 3 inches.

6. The disposable toilet seat wipe of claim 1 wherein said cleaning pad is composed of synthetic and natural fibers characterized by an ability to remain pre-moistened with any of said solutions over extended periods of time.

7. The disposable toilet seat wipe of claim 6 wherein said solution employed is characterized by an ability to quickly dry when exposed to ambient air.

* * * * *